US010684105B2

(12) United States Patent
Hill

(10) Patent No.: US 10,684,105 B2
(45) Date of Patent: Jun. 16, 2020

(54) ARROW FLETCHING APPARATUS WITH TAPERED BODY

(71) Applicant: Daniel Jones Hill, Commerce, GA (US)

(72) Inventor: Daniel Jones Hill, Commerce, GA (US)

( * ) Notice: Subject to any disclaimer, the term of this patent is extended or adjusted under 35 U.S.C. 154(b) by 134 days.

(21) Appl. No.: 16/039,282

(22) Filed: Jul. 18, 2018

(65) Prior Publication Data

US 2020/0025538 A1 Jan. 23, 2020

(51) Int. Cl.
*F42B 6/06* (2006.01)

(52) U.S. Cl.
CPC ..... *F42B 6/06* (2013.01)

(58) Field of Classification Search
CPC ..... F42B 6/06
USPC ..... 473/586
See application file for complete search history.

(56) References Cited

U.S. PATENT DOCUMENTS 4,204,307 A 5/1980 Pfetzing
5,427,385 A * 6/1995 Conrad ..... F42B 6/003 473/586
6,695,727 B1 * 2/2004 Kuhn ..... F42B 6/06 473/586
7,229,371 B2 * 6/2007 Walsh ..... F42B 6/06 473/586
7,331,886 B2 2/2008 Morris et al.
7,874,947 B1 1/2011 Wolfinbarger et al.
7,892,119 B2 * 2/2011 Marshall ..... F42B 6/06 473/586
7,955,201 B2 6/2011 Harwath et al.
8,382,616 B2 * 2/2013 Marshall ..... F42B 6/06 473/578
8,465,384 B2 6/2013 Blosser et al.
8,870,691 B2 10/2014 Marshall
9,046,329 B2 6/2015 Blosser et al.
9,410,776 B1 * 8/2016 Hill ..... F42B 6/06
9,448,046 B2 * 9/2016 Simo ..... F42B 6/06
9,518,805 B1 12/2016 Daniels
2010/0167849 A1 7/2010 Malucelli
2015/0005115 A1 1/2015 Owen

* cited by examiner

*Primary Examiner* — Joshua T Kennedy

(57) ABSTRACT

An arrow fletching apparatus with tapered body for use in the sport of archery is provided. The fletching apparatus is used in place of a fletching jig and glue conventionally used to fix fletching to an arrow shaft. The tapered body provides for an overall reduced weight of the apparatus.

1 Claim, 3 Drawing Sheets

ARROW FLETCHING APPARATUS WITH TAPERED BODY

BACKGROUND OF THE INVENTION

Field of the Invention

The present invention relates generally to archery, and specifically to adding fletching to arrows.

Description of the Related Art

In the sport of archery, arrow fletching serves the purpose of stabilizing an arrow in flight by providing drag at the tail end of the arrow, and in the case of helical or offset fletching, rotation that further provides a gyroscopic effect. Furthermore, arrow stability in flight depends largely on a balance between the drag provided by the fletchings and the mass they add to the tail end of the arrow compared to the mass of the leading end of the arrow. In other words, more mass may be added to the tail end, but must be accompanied by more drag on the tail end and more mass on the leading end in order to keep the arrow stable. The balance of leading end mass compared to tail end mass is widely known as front of center, abbreviated FOC, which describes the center of mass versus the geometric center of the arrow. Optimally, the tail mass, including fletchings, should be as little as possible.

In the typical process of arrow construction, fletchings are added to the arrow shaft by placing them in a jig for alignment and adding adhesive which can take from several minutes to hours to cure properly. Skill and patience are required to prepare the shaft and to apply the proper amount of adhesive in order to achieve a durable bond. During the course of shooting the arrows, it is not uncommon to damage fletchings, especially when shooting at a single spot on a target. This means that the active archer is perpetually repairing arrows.

Therefore, it is desirable to have an apparatus that reduces the time it takes to repair an arrow, is capable of accepting a wide range of the commonly available fletchings, and has as little mass as possible.

BRIEF SUMMARY OF THE INVENTION

The present invention consists of a body which slides over the tail end of an arrow shaft, being held to the shaft by means of either a friction fit or adhesive, and has slots adapted to accept fletchings, being removably held to the body by a friction fit. Each slot is formed within a protrusion on the body. The body is generally cylindrical and has a tapered profile, having a larger diameter near the leading end and a smaller diameter near the tail end. The tapered profile follows from a transition of the protrusions and slots where the cross sections of the protrusions gradually approach the center of the arrow shaft from the leading end to the tail end. In their transition, the protrusions and slots are truncated by a hole extending longitudinally through the body and the bottom of the slots are exposed to the hole, and thus the arrow shaft when the body is installed to an arrow shaft. Fletchings are inserted starting at the leading end and pushed rearward. The base of the fletchings contacts the bottom of the slots on the body at the leading end, whereas at the tail end, the base of the fletchings contact the arrow shaft itself due to the transition.

The taper transition allows the body to remain a single piece with as little mass as possible. Having the slot extend beyond the protrusions, rather than containing the slot for the entire length of the body, eliminates unnecessary mass. Furthermore, the gradual transition causes the fletching to become wedged between the top of the slot and the arrow shaft at the tail end, creating a more secure fit for a wider range of fletchings.

BRIEF DESCRIPTION OF THE DRAWINGS

The present invention is shown in the following Figures where.

DETAILED DESCRIPTION OF THE INVENTION

Figure 1:
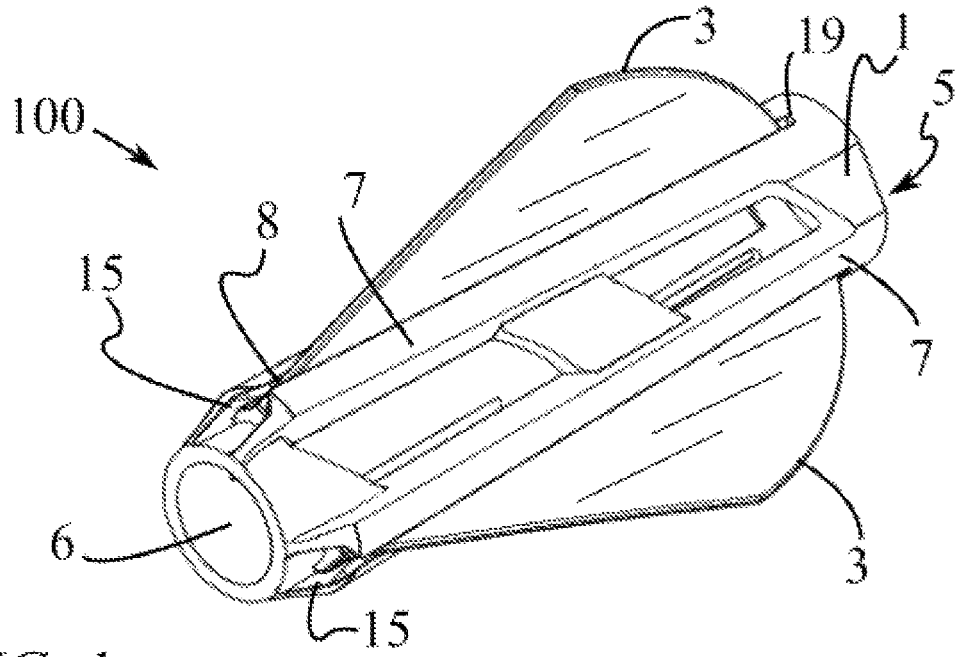
FIG. 1 is a perspective view of the preferred embodiment of the present invention.

With reference to the drawings, a preferred embodiment of the arrow fletching apparatus with tapered body, generally designated by reference numeral 100, will be described.

As can best be seen in FIG. 1, fletching apparatus 100 comprises a body 1 and a plurality of fletchings 3, where body 1 comprises a hole 6 adapted to fit over the shaft of an arrow, a plurality of protrusions 7, the protrusions themselves each comprising a slot 8. Slot 8 comprises a leading end opening 15 for the purpose of installation of fletching 3, and a termination 19 at the tail end 5 of body 1 for the purpose of containing fletching 3. Body 1 is preferably constructed of a stiff polymer or other similarly lightweight rigid material and may be manufactured by a 3D printing process, injection molding, machining, or other conventional manufacturing means.

Figure 2:
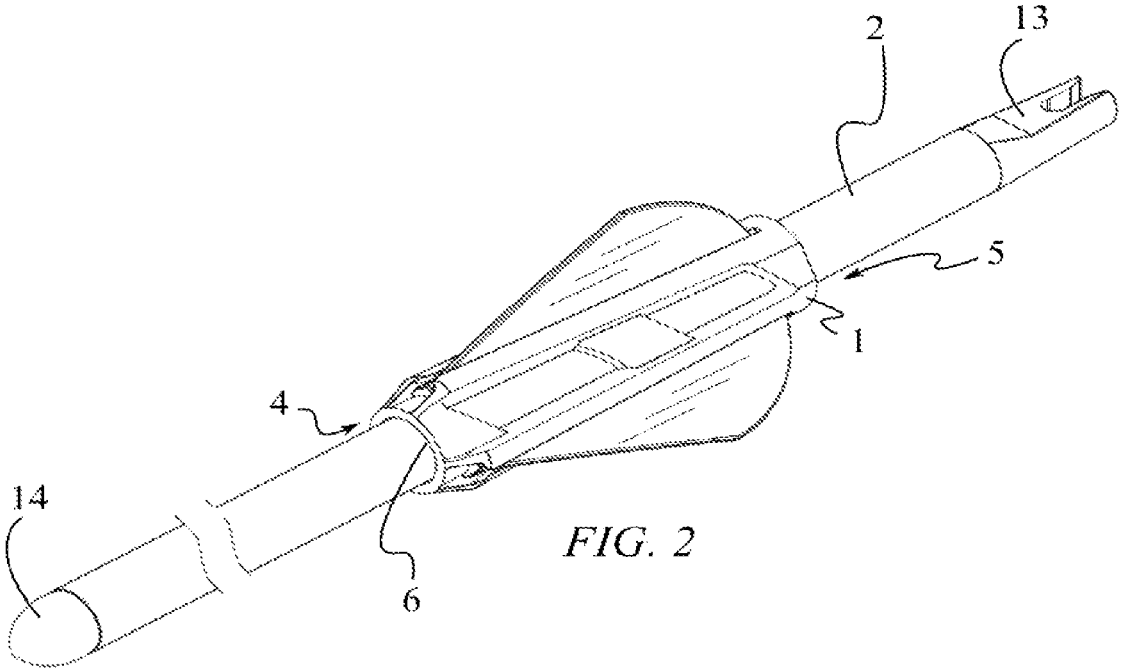
FIG. 2 is a perspective view of the preferred embodiment of the present invention as installed to an arrow shaft.

FIG. 2 shows the present invention as installed to an arrow shaft 2. The leading end 4 of body 1 is preferably installed to arrow shaft 2 facing the arrow point 14, and the tail end 5 of body 1 is preferably installed facing arrow nock 13. Body 1 is installed to arrow shaft 2 via hole 6 where hole 6 is adapted to fit over arrow shaft 2.

Figure 3:
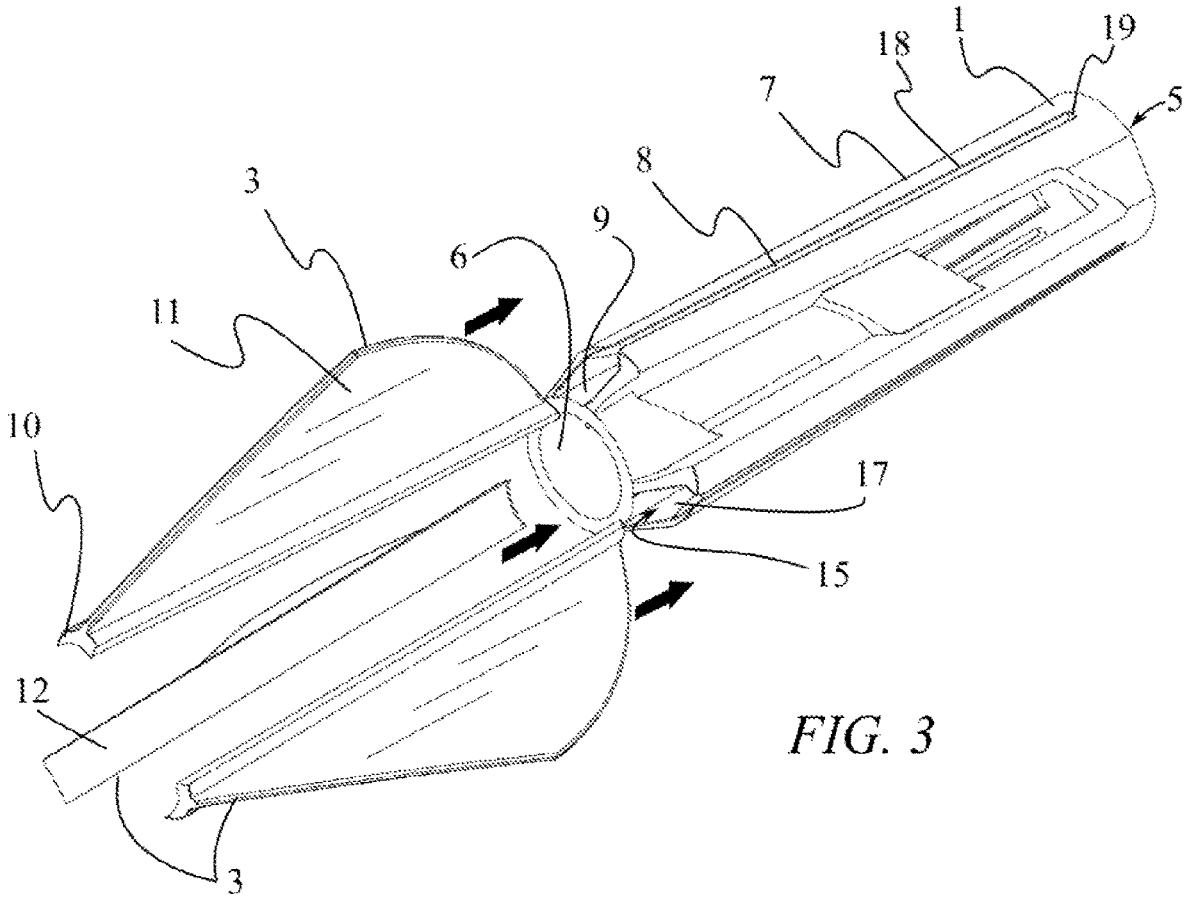
FIG. 3 is an exploded view showing how fletchings are installed to the body in the preferred embodiment.

As can best be seen in FIG. 3, the fletchings 3 are installed to the body 1 through the leading end opening 15, and pushed rearward to the slot termination 19 near tail end 5. Similarly, the fletchings 3 are removed by pulling them forward through the leading end opening 15. Slot 8 is oriented generally longitudinally with protrusion 7 and comprises a generally narrow portion 18 oriented radially outward away from hole 6 where generally narrow portion 18 is adapted to engage fletching planar surface 11. Slot 8 also comprises a generally wide portion 17 oriented radially inward toward hole 6 where generally wide portion 17 is adapted to engage fletching base 10. Slot bottom surface 9 is located at the radially innermost surface of generally wide portion 17 and is adapted to engage bottom surface 12 of fletching base 10.

Figure 4A:
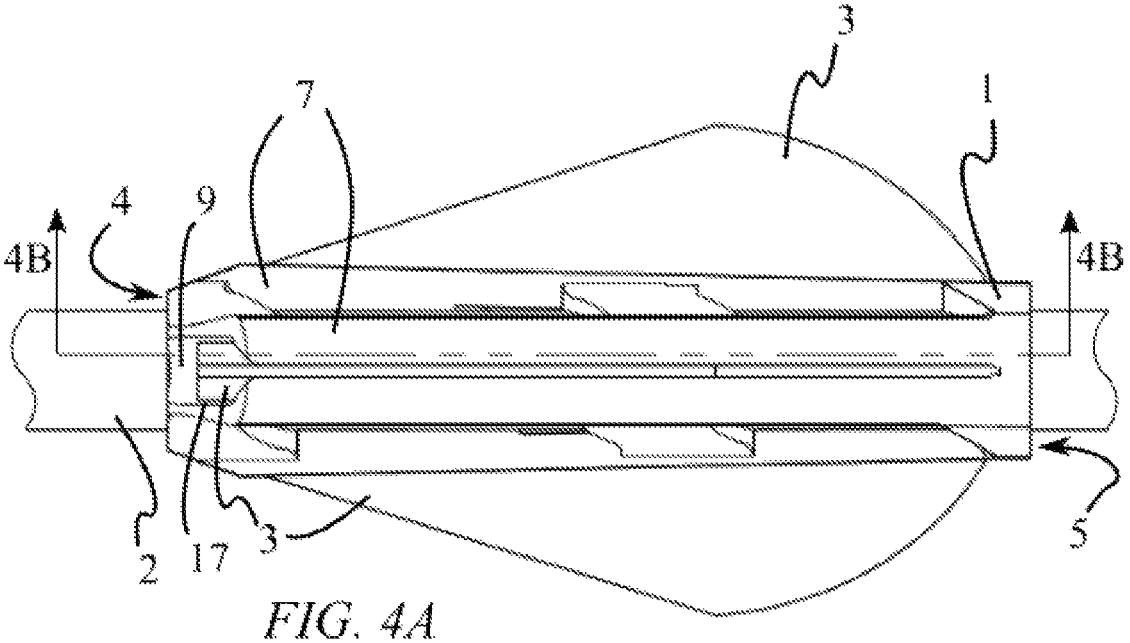
FIG. 4A is an elevation view of the present invention in a preferred embodiment
Figure 4B:
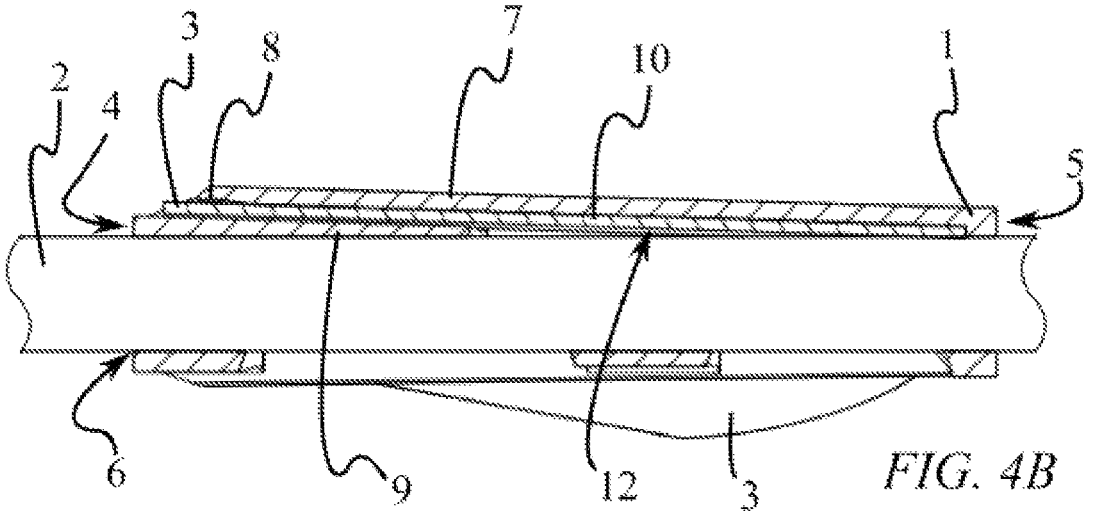
FIG. 4B is a section view of a preferred embodiment showing the protrusion transition.

Referring to FIGS. 4A-4B, FIG. 4A shows an elevation view of body 1 of the present invention. The broken line 4B-4B is drawn just off the longitudinal axial center of body 1 in order to best show the transition of protrusion 7 and slot 8 as shown in the section view FIG. 4B. Protrusions 7 and slots 8 begin at a position farther from hole 6, and subsequently arrow shaft 2, near the leading end 4 compared to the tail end 5. There is a gradual transition of the position of the protrusions 7 and slots 8 from the leading end 4 to the tail end 5. At a point between leading end 4 and tail end 5, the slot bottom surface 9 is truncated by hole 6, resulting in a reduction in material near tail end 5. When arrow shaft 2 is inserted into hole 6 there is an overall reduction in the height of generally wide portion 17 of slot 8 near tail end 5, providing for an interference fit between a fletching and arrow shaft 2. Specifically, bottom surface 12 of base 10 of fletching 3 contacts arrow shaft 2 near tail end 5, whereas bottom surface 12 of fletching base 10 contacts slot bottom surface 9 near leading end 4.

What is claimed:

1. An arrow fletching apparatus comprising:

a generally cylindrical body having a leading end, a tail end, and a hole extending longitudinally through a center of said body such that an arrow shaft is configured to fit within said body through said hole, said body further comprises a plurality of protrusions spaced radially about said body and oriented generally longitudinally along said body, a profile of the plurality of protrusions tapering from the leading end to the tail end of said body, wherein each said protrusion comprises a slot oriented generally longitudinally with said protrusion with an opening of said slot near the leading end of said body, said slot is adapted to accept a fletching, each said slot comprises a narrow portion and a wide portion;

a plurality of fletchings, wherein each fletching of said plurality of fletchings comprises a planar flight control surface and a base oriented approximately perpendicular to said planar flight control surface on one or both sides of said planar flight control surface;

wherein said wide portion of each of said slots comprises a bottom surface configured to engage a bottom surface of said base of a corresponding one of said plurality of fletchings, and an upper surface divided by said narrow portion, wherein said upper surface is adapted to engage a top surface of said base of said corresponding one of said plurality of fletchings, said bottom surface of said wide portion of said slot is truncated by said hole passing through said body between said leading end and said tail end, said truncation exposes the bottom surface of said fletching to contact with an outer surface of an arrow shaft near a tail end such that each said base of said plurality of fletchings are configured to be wedged between said upper surface of said wide portion of said slot and an outer surface of an arrow shaft.

* * * * *